United States Patent [19]

Bell

[11] Patent Number: 4,474,229

[45] Date of Patent: Oct. 2, 1984

[54] AIR PREHEATER

[75] Inventor: Alan Bell, Cookham, England

[73] Assignee: Foster Wheeler Energy Corporation, Livingston, N.J.

[21] Appl. No.: 408,343

[22] Filed: Aug. 16, 1982

[30] Foreign Application Priority Data

Aug. 19, 1981 [GB] United Kingdom ..... 25341

[51] Int. Cl.[3] ..... F28F 27/00

[52] U.S. Cl. ..... 165/103; 165/47; 165/104.14

[58] Field of Search ..... 165/134, 104.21, 47, 165/DIG. 12, 104.14, 103, DIG. 28

[56] References Cited

FOREIGN PATENT DOCUMENTS 542702 6/1957 Canada ..... 165/134
1294211 4/1962 France ..... 165/104.21
915291 1/1963 United Kingdom ..... 165/134
2076134 11/1981 United Kingdom ..... 165/134

*Primary Examiner*—Albert W. Davis, Jr.
*Attorney, Agent, or Firm*—Marvin A. Naigur; John E. Wilson; Warren B. Kice

[57] ABSTRACT

The invention relates to air heaters and provides a means by which the operation of heat exchangers therein can be sustained at an optimum efficiency. The invention proposes the incorporation of a preheater (16) for incoming unheated air which can be selectively thermally coupled to heated air in an outlet duct (12) from the heat exchanger (4). During normal operation the heated air bypasses the thermal coupling, but when the temperature of the incoming unheated air is particularly low, the coupling is made and the incoming air thereby preheated to ensure efficient operation of the heat exchanger.

4 Claims, 2 Drawing Figures

AIR PREHEATER

BACKGROUND TO THE INVENTION

The invention relates to an air heater, and seeks to provide a simple heater arrangement which can accommodate substantial variations in the air inlet temperature.

Known air heaters operate on a straightforward heat exchange principle; a hot fluid, normal gas such as combustion gases from a burner gives up heat to the air as it flows through the heater. A typical heat exchanger employs heat pipes to effect the transfer of heat from an hot fluid duct to the air duct. While this arrangement is generally satisfactory, when the air inlet temperature falls, so does the efficiency of the heat exchanger which is adversely affected, resulting in a disproportionately lowered outlet temperature. This can produce problems in the installation to which the heated air is to be fed.

SUMMARY OF THE INVENTION

According to the invention an air preheater comprises an heat source coupled to an heat exchanger located in an air flow path between an inlet duct, and an outlet duct therefor; an air preheater in the inlet duct; and means for selectively thermally coupling the preheater with heated air in the outlet duct to heat incoming air prior to passage through the heat exchanger. Normally, the heat source comprises a duct for hot gases located adjacent the air flow path, and the heat exchanger comprises a plurality of heat pipes traversing the hot gas duct and the air flow path.

In normal operation the heated air bypasses the thermal coupling, but when the air inlet temperature is particularly low, the heated air can be directed over the thermal coupling to maintain the preheater temperature and ensure that the air inlet temperature to the main heat exchanger is sustained at a substantially constant level. This enables the heat exchanger to operate under substantially the same temperature conditions at all times and thus at the same optimum efficiency. The preheater may also be of the heat pipe type, and the thermal coupling can be selectively exposed to the heated air by means of a simple damper arrangement.

BRIEF DESCRIPTION OF THE DRAWINGS

The invention will now be described by way of example and with reference to the accompanying schematic drawings wherein.

DESCRIPTION OF THE PREFERRED EMBODIMENTS

Figure 1:
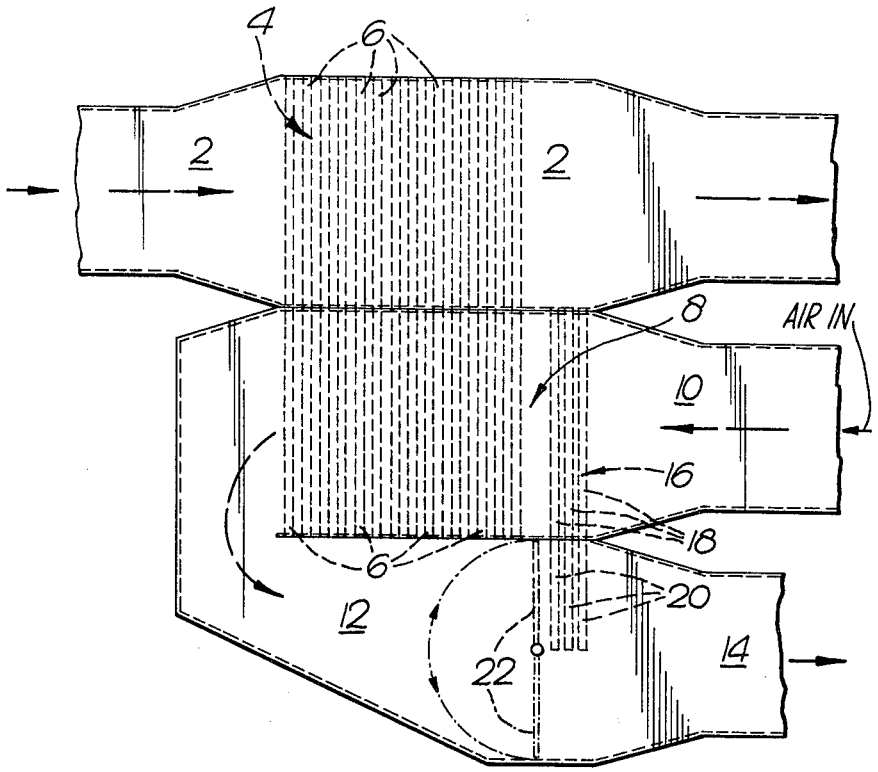
FIG. 1 is a plan view of an heat pipe air heater demonstrating the principle of the invention.

In the heater of FIG. 1 hot gases from for example a burner or boiler pass along a duct 2, across which is arranged a heat exchanger bank 4 of heat pipes 6. The pipes 6 extend into and across an air duct 8 which receives air to be heated from an inlet 10. From the duct 8 the heated air passes to a discharge chamber 12 and thence to an air outlet 14. Arranged in the duct 8 upstream of the pipes 6 is a preheater 16. The preheater 16 comprises a second bank 18 of heat pipes 20 which extend into the discharge chamber 12. A damper 22 arranged in the discharge chamber 12 is movable between a first position shown, at which the heated air is directed across the extending pipes 20 to a second position indicated in dotted line at which the heated air is directed over the pipes 20 which thus thermally couple the discharge chamber to the air duct 8, upstream of the heat exchanger 4.

With the damper 22 in its first position the heater will operate under normal conditions with typical temperatures being about 370° C. to 150° C. for the gas and about 25° C. to 300° C. for the air. When the air inlet temperature falls substantially to say −18° C., the damper is moved to its second position, boosting the preheater to maintain the air temperature at the entrance to the heat exchanger 4 at about 25° C. The air temperature at the outlet of the heat exchanger 4 will therefore be maintained at about 300°, assuming the air flow rates remain substantially constant, although the air will of course be cooled at the thermal coupling with the preheater 16 to produce an outlet temperature of about 260° C. More importantly though, the main heat exchanger 4 will operate under the same temperature conditions and in this way can operate at the same (optimum) efficiency. A temperature sensitive switch may be included to automatically move the damper 22 to its second position when the temperature of the incoming air falls below a predetermined value, and vice versa.

Figure 2:
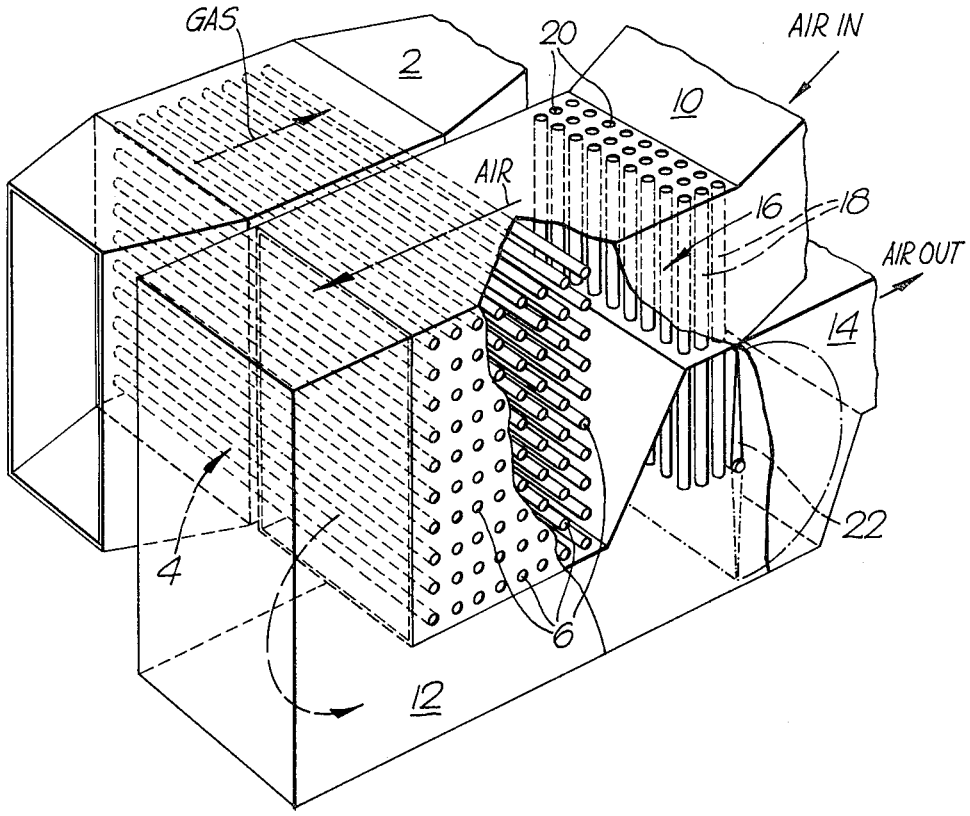
FIG. 2 is a broken perspective view showing one preferred orientation of the heat pipes.

In the heater shown in FIG. 2 the arrangement is essentially the same but the heat pipes 6 of the heat exchanger 4 are arranged laterally, while those 20 of the preheater bank 18 are arranged vertically. This facilitates pipe withdrawal for maintenance and makes a simple practical arrangement. Also, the damper 22 is here located downstream of the heat pipes 20. In both arrangements illustrated, the preheater pipes 20 in the discharge chamber 12 can be maintained at a substantially constant temperature of about 90° C. by the heated air.

I claim:

1. An air heater comprising a heat source coupled to a heat exchanger located in an air flow path between an inlet duct and an outlet duct therefor; an air preheater in the inlet duct; and means for selectively coupling the preheater with heated air in the outlet duct to heat incoming air prior to passage through the heat exchanger wherein the preheater comprises a plurality of heat pipes in the inlet duct and extending into the outlet duct, the coupling means being operative to selectively direct the passage of heated air across the extended portions of the heat pipes.

2. An air heater according to claim 1 wherein the coupling means comprises a damper movable between a first position at which it blocks passage of air across said heat pipe portions and a second position at which said portions are exposed to heated air.

3. An air heater according to claim 2 wherein in said second position, the damper directs the passage of all heated air across said heat pipe portions.

4. An air heater according to claim 1 wherein the heat pipes of the heat exchanger are substantially perpendicular to those of the preheater.

* * * * *